US005406894A

United States Patent [19]

Herrmann et al.

[11] Patent Number: 5,406,894

[45] Date of Patent: Apr. 18, 1995

[54] SHELVING SYSTEM

[75] Inventors: Robert S. Herrmann, Grand Haven; Edmund J. Kane; Gregory T. Wolters, both of Holland; Donald C. Gilbert, Muskegon Heights, all of Mich.

[73] Assignee: Donnelly Technology, Inc., Holland, Mich.

[21] Appl. No.: 147,827

[22] Filed: Nov. 4, 1993

Related U.S. Application Data

[62] Division of Ser. No. 744,938, Aug. 14, 1991, Pat. No. 5,297,486.

[51] Int. Cl.[6] ..... A47B 9/00

[52] U.S. Cl. ..... 108/108; 248/250

[58] Field of Search ..... 108/108, 107, 157; 248/250, 243, 467, 205.3, 221.3, 221.4, 220.2

[56] References Cited

U.S. PATENT DOCUMENTS

| | | | |
|---|---|---|---|
| D. 295,950 | 5/1988 | Johnston . | |
| 377,232 | 1/1888 | Bray . | |
| 392,061 | 10/1888 | Peckham . | |
| 883,323 | 3/1908 | MacDuff | 288/250 |
| 988,558 | 4/1911 | England . | |
| 1,156,008 | 10/1915 | Humphrey . | |
| 1,751,463 | 3/1930 | Backus et al. . | |
| 1,891,637 | 12/1932 | Frank . | |
| 2,256,068 | 9/1939 | Voster . | |
| 2,281,999 | 5/1942 | Rieback . | |
| 2,568,153 | 9/1951 | Hickman . | |
| 2,599,607 | 6/1952 | Burris . | |
| 2,626,773 | 1/1953 | Backman . | |
| 2,640,246 | 6/1953 | Shomber . | |
| 2,665,953 | 1/1954 | Maroney et al. . | |
| 2,681,786 | 6/1954 | Sparring . | |
| 2,739,777 | 3/1956 | Schoenhardt . | |
| 2,954,125 | 9/1960 | Husted . | |
| 2,960,803 | 11/1960 | Bonistall . | |
| 2,980,975 | 4/1961 | Jones . | |
| 3,082,880 | 3/1963 | Mapson . | |
| 3,092,047 | 6/1963 | Chesley . | |
| 3,102,499 | 9/1963 | Shelor | 108/28 X |
| 3,127,146 | 3/1964 | Fisher | 248/250 |
| 3,185,315 | 5/1965 | Andreassen . | |
| 3,212,836 | 10/1965 | Johnson . | |
| 3,270,404 | 9/1966 | Andreassen . | |
| 3,270,995 | 9/1966 | Shears . | |
| 3,317,167 | 5/1967 | Becker et al. . | |
| 3,429,628 | 2/1969 | Laszlo . | |
| 3,439,812 | 4/1969 | Nagelkirk et al. . | |
| 3,446,361 | 5/1969 | Douty . | |
| 3,565,381 | 2/1971 | Oliver | 248/250 X |
| 3,575,484 | 4/1971 | Kesling . | |
| 3,604,669 | 9/1971 | Asher . | |
| 3,633,983 | 1/1972 | Whitcomb . | |
| 3,680,914 | 8/1972 | Stephenson et al. . | |

(List continued on next page.)

FOREIGN PATENT DOCUMENTS

| | | | |
|---|---|---|---|
| 225385 | 1/1963 | Austria | 248/221.4 |
| 069235 | 3/1984 | European Pat. Off. . | |
| 8909339 | 12/1989 | Germany . | |
| 320487 | 10/1929 | United Kingdom . | |
| 1002175 | 8/1965 | United Kingdom . | |
| 1223738 | 3/1971 | United Kingdom | 248/221.3 |
| 1495541 | 12/1977 | United Kingdom . | |

*Primary Examiner*—Jose V. Chen

*Attorney, Agent, or Firm*—Price, Heneveld, Cooper, DeWitt & Litton

[57] ABSTRACT

A shelf assembly has a shelf support bracket and a shelf panel supported by the bracket. A fastening stud projects from the shelf panel into a figure eight shaped aperture in the support bracket. The fastening stud slides relative to the fastening aperture and has a resilient, compressible bushing for latching engagement with the fastening aperture. In one embodiment, the rear edge of the shelf panel is positioned in an open sided channel member of the support bracket. In another embodiment, a spring clip is substituted for the fastening stud and projects from the shelf panel into a fastening aperture in the support bracket, the fastening aperture having a lip for latching engagement with the spring clip.

24 Claims, 10 Drawing Sheets

U.S. PATENT DOCUMENTS

| | | | |
|---|---|---|---|
| 3,741,405 | 6/1973 | McConnell et al. . | |
| 3,862,784 | 1/1975 | Heinrich . | |
| 3,912,085 | 10/1975 | Cooke et al. . | |
| 4,015,543 | 4/1977 | Stankowitz . | |
| 4,101,233 | 7/1978 | McConnell . | |
| 4,103,855 | 8/1978 | Grosse | 108/108 X |
| 4,167,259 | 9/1979 | Bury . | |
| 4,225,265 | 9/1980 | Hooker et al. . | |
| 4,262,809 | 4/1981 | McConnell . | |
| 4,386,871 | 6/1983 | Hooker et al. . | |
| 4,429,850 | 2/1984 | Weber et al. | 108/108 X |
| 4,536,904 | 8/1985 | Whitehead | 248/221.3 X |
| 4,723,809 | 2/1988 | Kida et al. . | |
| 4,735,391 | 4/1988 | Lawrence . | |
| 4,736,918 | 4/1988 | Bessinger . | |
| 4,822,656 | 4/1989 | Hutter, III . | |
| 4,841,698 | 6/1989 | Gold . | |
| 4,870,907 | 10/1989 | McKee | 108/42 |
| 4,871,136 | 10/1989 | Bessinger et al. | 108/108 X |
| 4,915,413 | 4/1990 | Meyer . | |
| 4,923,260 | 5/1990 | Poulsen . | |
| 4,934,541 | 6/1990 | Bussan et al. . | |
| 4,938,442 | 7/1990 | Mastrodicasa | 248/250 |
| 5,044,588 | 9/1991 | Gunter . | |

SHELVING SYSTEM

This is a division of application Ser. No. 07/744,938, filed Aug. 14, 1991, now U.S. Pat. No. 5,297,486.

BACKGROUND OF THE INVENTION

The present invention relates to shelving assemblies and specifically to a shelving panel and support bracket subassembly which may be used in a display case, in a refrigerator, or on an office partition panel, or the like, where a removable or adjustable shelving panel and support bracket assembly is desired.

A wide variety of shelving assemblies are presently available and may be generally categorized into three groups. First, the simplest type of shelving assembly will typically include a pair of support brackets projecting from a wall surface with a shelf panel placed upon the brackets without secure attachment of the shelf to the brackets. This type of assembly may be seen in U.S. Pat. No. 3,604,669, entitled SHELF BRACKET STRUCTURE and issued on Sep. 14, 1971, to Asher, for example. However, this simple type of shelving assembly is unstable and susceptible to being dislodged or Jarred, spilling items disposed on the shelf.

A second category of shelving assemblies includes modification to the first category by the addition of fasteners for securing the shelf panel to the support bracket. This type of assembly may be seen in U.S. Pat. No. 3,127,146, entitled SHELF SUPPORTS AND THE LIKE and issued on Mar. 31, 1964, to Fisher, for example. This arrangement adds some stability to the shelving assembly over the first type of shelving assembly. However, these shelving assemblies typically require the use of tools to assemble the fasteners. Further, the fasteners are typically small and easily lost.

The third category of shelving assemblies includes preassembled support bracket and shelving panel units. These units are commonly used with office partition panels and overcome the assembly problems of the second category assemblies. However, these units are typically large and bulky, requiring significant storage space when not in use.

SUMMARY OF THE INVENTION

The present invention answers the above identified shelving assembly difficulties by providing a shelf support bracket, a shelf panel and panel-to-bracket fastening which does not require the use of tools to assemble. A shelf assembly according to the present invention provides a stable shelf and is especially useful for shelving applications where a glass shelf panel is preferred for esthetic reasons or for light transmission, wherein the present shelving assembly provides secure fastening of a glass shelf panel. Further, the present shelving assembly may be compactly stored when not in use.

In one embodiment, the present shelving assembly uses a fastening stud which projects from one of a support bracket and a shelf panel toward the other of a support bracket and a shelf panel for latching engagement with a generally figure eight shaped aperture in the other of the support bracket and shelf panel. In another embodiment, an open sided channel is connected with the support bracket and a rear edge of the shelf panel is positioned in the channel.

In an alternative embodiment, a spring clip projects from one of a support bracket and a shelf panel toward the other of a support bracket and a shelf panel for latching engagement with a fastening aperture to fasten the support bracket and shelf panel together. In another embodiment, an open sided channel, connected with the support bracket, is added and a rear edge of the shelf panel is positioned in the channel.

Shelf assemblies according to the present invention are easily assembled without the use of tools and do not require the use of loose fasteners which may be lost. They provide a stable shelf with the shelf panel, including glass shelf panels, securely fastened to its support. Further, these shelf assemblies store compactly when not in use.

These and other objects, advantages and features of the present invention will become apparent upon review of the following specification in conjunction with the drawings.

BRIEF DESCRIPTION OF THE PREFERRED DRAWINGS

DESCRIPTION OF THE PREFERRED EMBODIMENT

Figure 1:
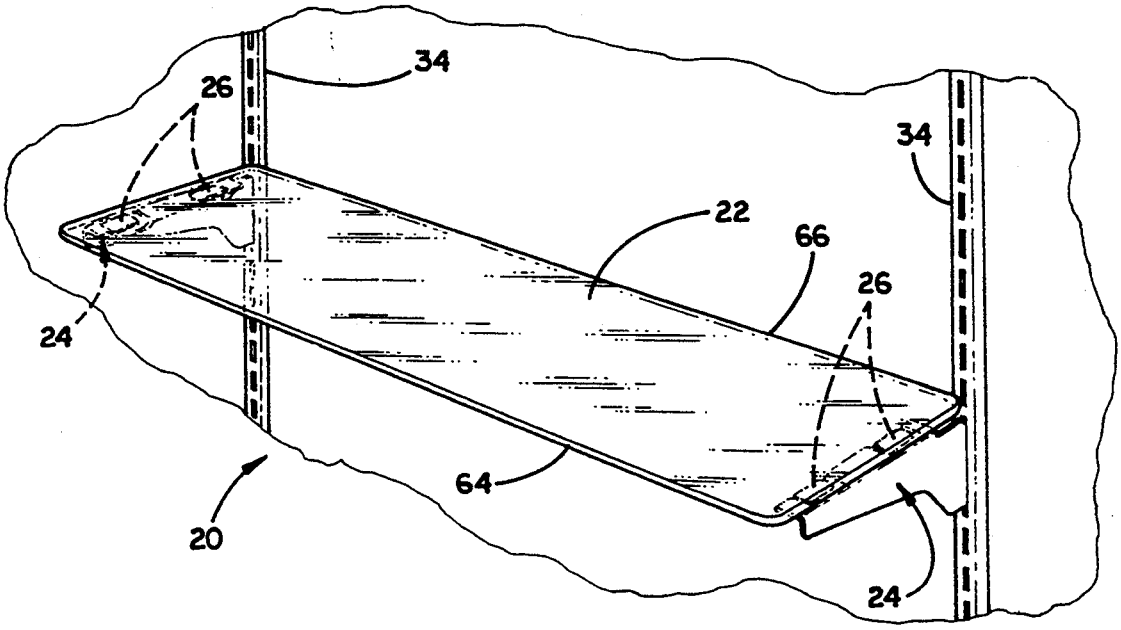
FIG. 1 is a perspective view of a shelf according to the present invention.

Referring to the drawings in greater detail, a shelf assembly 20 according to the present invention has a shelf panel 22, a pair of shelf support brackets 24, and fasteners 26 for fastening panel 22 and brackets 24 together (FIGS. 1–7). Shelf panel 22 may be fabricated from any suitable shelving material, but is preferably a light transmitting material and, most preferably, is optically clear, tempered glass to enhance light distribution.

Figure 2:
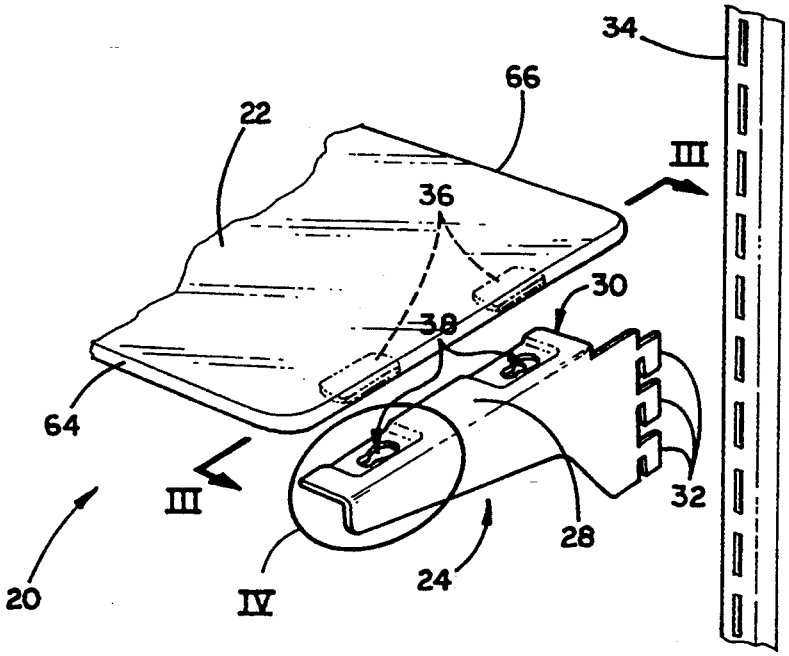
FIG. 2 is an exploded fragmentary perspective view of the shelf of FIG. 1.
Figure 3:
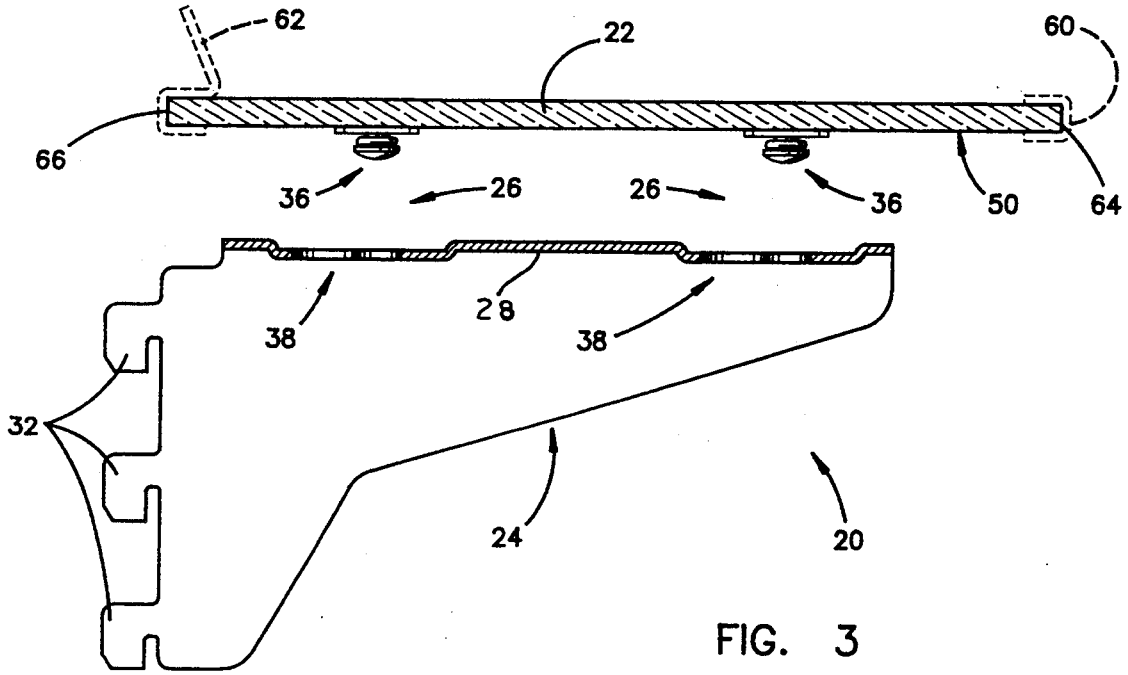
FIG. 3 is a sectional view taken along line III—III of FIG. 2.

Support brackets 24 are elongated members having a flange portion 28 and a support surface 30 for receiving and supporting shelf panel 22 (FIGS. 1–3). Support brackets 24 are adapted for connection with a wall surface and project substantially perpendicularly from the wall surface. Most preferably, brackets 24 are adapted for use in an adjustable shelving system as is often used with office partition panels or for refrigerator shelving. Thus, brackets 24 include mounting hooks 32 for engaging an adjustable shelving track 34 or the like. Further, brackets 24 may be stamped metal components or may be fabricated from any suitable material, including structural or engineering plastics.

Figure 5:
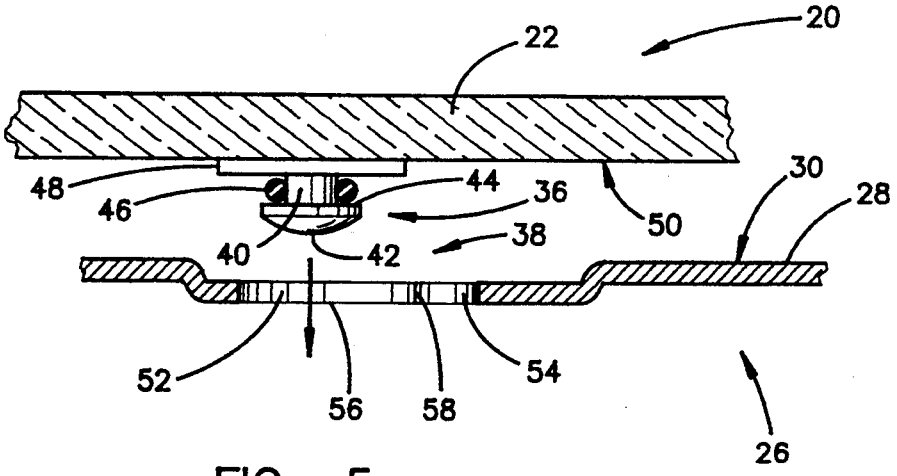
FIG. 5 is a fragmentary sectional view of detail IV of FIG. 2.
Figure 6:
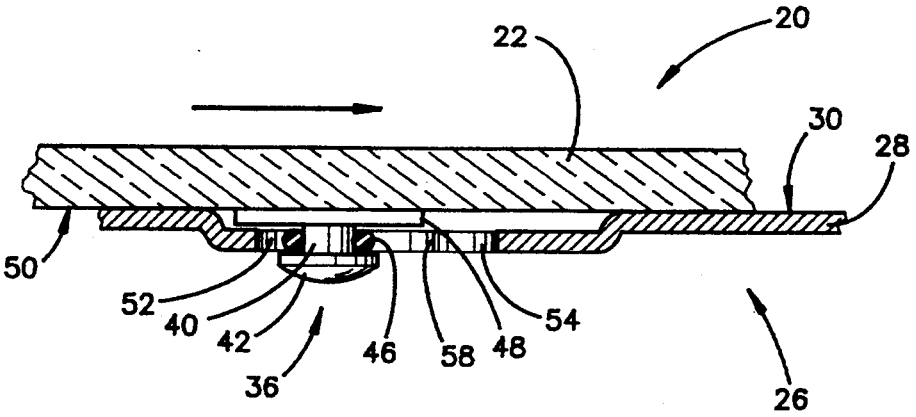
FIG. 6 is the view of FIG. 5 in a partially assembled position.
Figure 7:
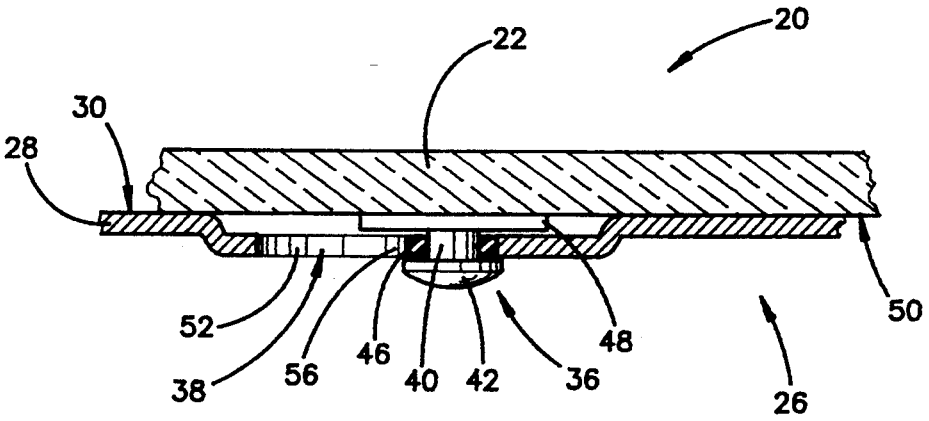
FIG. 7 is the view of FIG. 5 in an assembled position.
Figure 8:
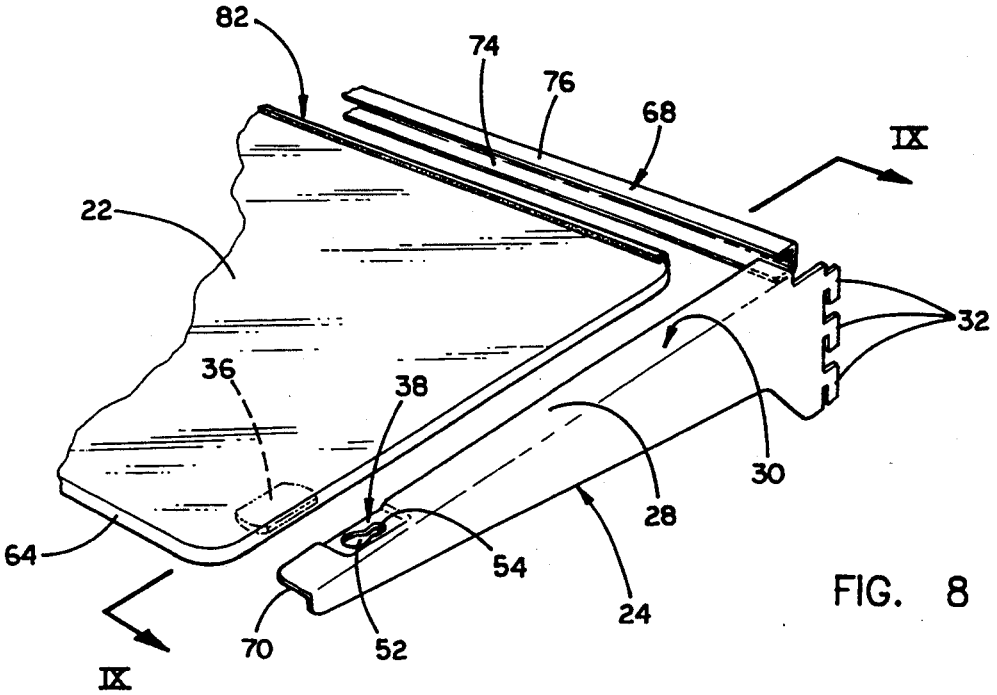
FIG. 8 is an exploded fragmentary perspective view of a first alternative embodiment of the shelf of FIGS. 1 and 2.

Fasteners 26 are two part devices including a fastening member or stud 36 and a corresponding fastening aperture 38 in flange 28 of bracket 24 (FIGS. 2 and 3). Fastening stud 36 has a shaft portion 40 and preferably a head 42 (FIGS. 5–7). Shaft 40 is preferably cylindrical and about 3/16 inch (4.8 mm) in diameter. Head 42 is preferably circular and about ⅜ inch (9.5 mm) in diameter, with a partially spherical outer surface. A lip or shoulder 44 is defined between shaft 40 and head 42 and circumscribes shaft 40.

Fastening stud 36 further includes a resilient, compressible bushing 46 fitted thereover which may be a commonly available, size 007, Buna-N rubber O-ring. Bushing 46 circumscribes shaft 40 and is positioned between head 42 and a mounting plate 48, located at the opposite end of shaft 40 from head 42. Mounting plate 48 is a generally rectangular plate, preferably about ⅜ inch by 1¾ inch (9.5 mm by 38.1 mm), and is used for bonding stud 36 to the bottom surface 50 of glass shelf panel 22. Stud 36 is preferably bonded to glass panel 22 using a bonding media. An activator and adhesive method using an activator available under the name Dymax 535 Activator and an adhesive available under product number 625, available from Dymax Engineering Adhesives in Torrington, Conn., may be used. An alternative bonding media is available under product number EA 951.1 from the Aerospace and Industrial Products Division of the Dexter Hysol Company in Seabrook, N.H. The bonding media used may require application of UV light or heat to complete curing.

Figure 4:
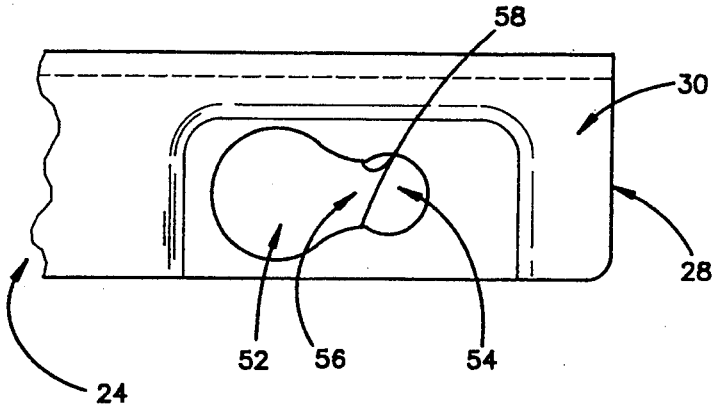
FIG. 4 is a plan view of detail IV of FIG. 2.

The corresponding fastening aperture 38 is generally figure eight shaped, having a large portion 52, a small portion 54, and a throat 56 extending between the large and small portions 52, 54 (FIG. 4). The large portion 52 is preferably circular and about 7/16 inch (11.1 mm) in diameter for slip fit engagement with fastening stud 36. Small portion 54 is also preferably circular and has a diameter of about 17/64 inch (6.7 mm) for a compression fit with bushing 46. Throat portion 56 is generally smoothly curved from large portion 52 to small portion 54. Throat 56 tangentially intersects large portion 52 and intersects small portion 54 to form shoulders 58. Throat 56 tapers from large portion 52 to small portion 54 to compress bushing 46 when stud 36 is slid from large portion 52 to small portion 54. Once stud 36 is in small portion 54, shoulders 58 and throat 56 resist sliding removal of stud 36 from small portion 54. Head 42 prevents axial removal of stud 36 from throat 56 and small portion 54, along the length of shaft 40. Further, each fastening aperture 38 is preferably recessed below support surface 30 to receive the thickness of mounting plate 48 and minimize any space between shelf panel 22 and support bracket 24.

A pair of similarly oriented, spaced fasteners 26 is provided in shelf assembly 20 for fastening shelf panel 22 with each support bracket 24 (FIGS. 1–3). The use of pairs of fasteners 26 enhances the stability of shelf assembly 20 by minimizing the possibility of rotation between shelf panel 22 and support brackets 24. Further, depending upon the application or use of shelf assembly 20, optional front 60 and rear 62 trim pieces may be used (FIGS. 2 and 3). Trim pieces 60 and 62 may be fabricated of any suitable material and adhered to the front 64 and rear 66 edges of shelf panel 22, respectively. Trim pieces 60 and 62 may be stamped metal, as is commonly known, such as aluminum for example, and are preferably bonded to shelf panel 22 as discussed above.

Shelf assembly 20 is easily assembled by aligning each fastening stud 36 with large portion 52 of a corresponding fastening aperture 38 and inserting head 42 through large portion 52 (FIGS. 5 and 6). Bottom surface 50 of shelf panel 22 is placed adjacent to support surface 30 of bracket flange 28 and shelf panel 22 is slid relative to bracket 24, sliding each fastening stud 36 through throat 56 and into small portion 54 of corresponding fastening apertures 38 (FIG. 7). Bushings 46 are compressed when studs 36 slide through throats 56 and remain slightly compressed in small portions 54. Shoulders 58 and the relatively smaller clearance through throats 56 provide a locking function to hold studs 36 in small portions 54 (FIG. 4). The slight compression of bushings 46 in small portions 54 provides a snug connection between shelf panel 22 and support bracket 24, minimizing potential rattling between the shelf panel 22 and support bracket 24.

In a first alternative embodiment 120 of shelf assembly 20, an open sided channel 68 extends between flange portions 28 of support brackets 24 and one fastener 26 is provided to connect shelf panel 22 with each support bracket 24 (FIGS. 8–11). Channel 68 is connected with flange portion 28 at a rear end 70 and is positioned to receive rear edge 66 of shelf panel 22. Fastener 26 is positioned near a front end 72 of flange portion 28, which also locates fastener 26 near front edge 64 of shelf panel 22.

Figure 9:
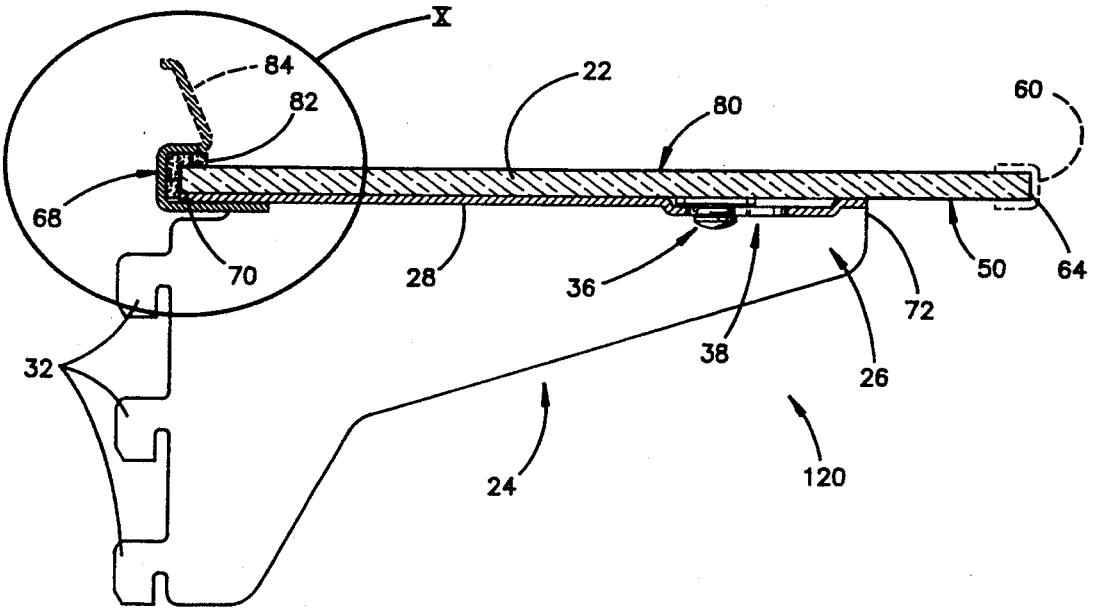
FIG. 9 is a sectional view along line IX—IX of FIG. 8 showing the shelf assembled.
Figure 10:
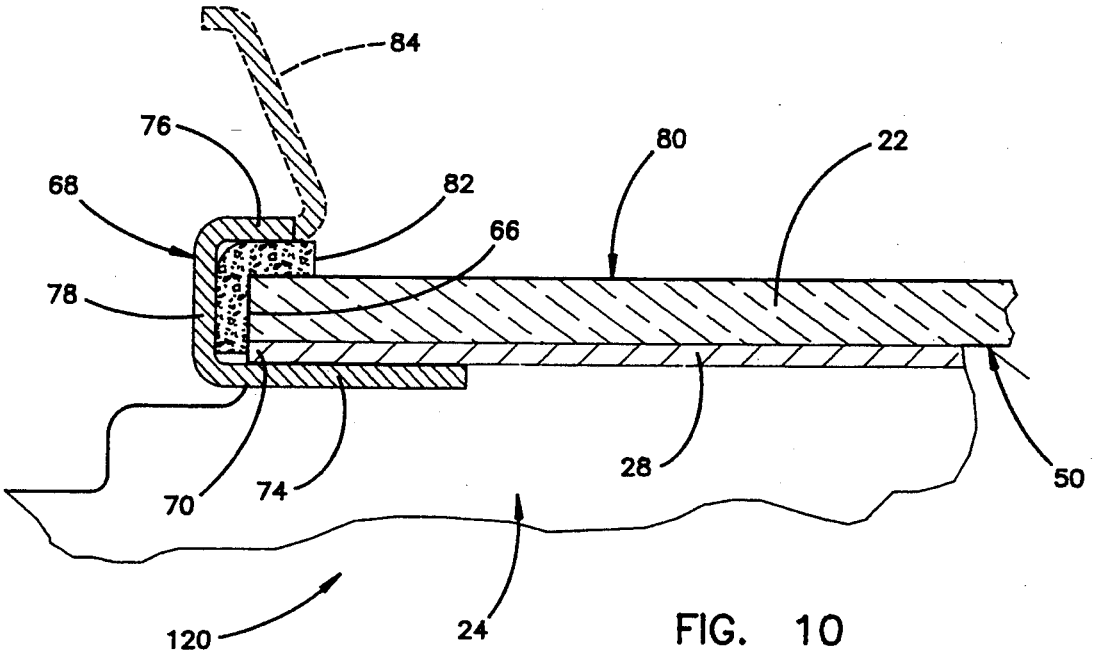
FIG. 10 is a fragmentary sectional view of detail X of FIG. 9.
Figure 11:
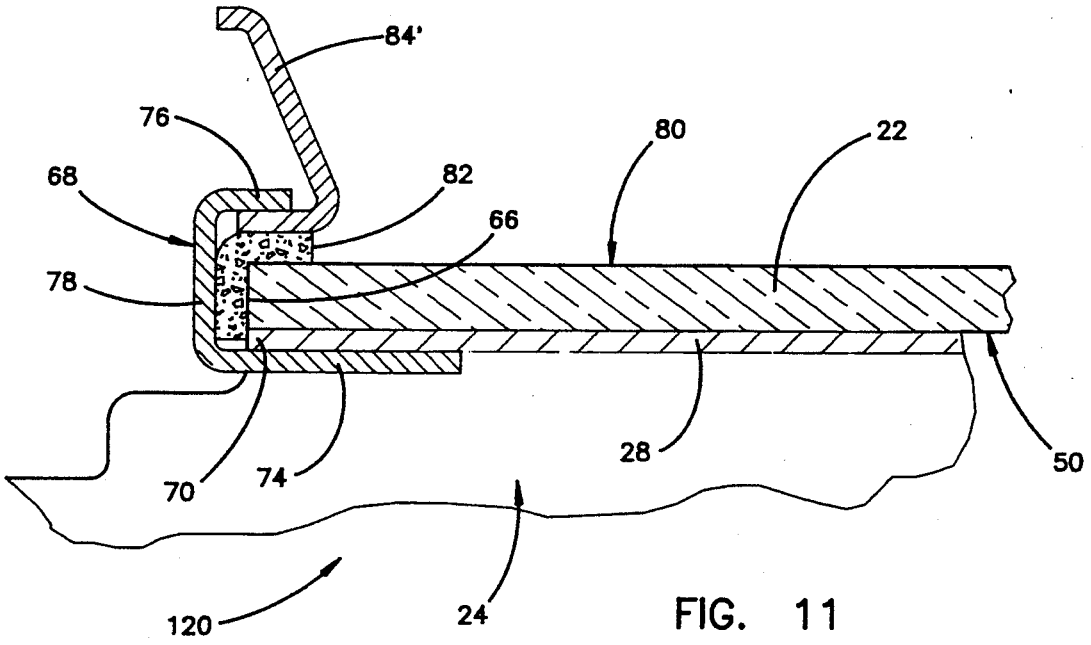
FIG. 11 is an alternative arrangement of the detail of FIG. 10.

Channel 68 is preferably formed from metal and is generally J-shaped in cross section with a long leg 74 and a short leg 76 extending in the same general direction from opposing edges of a web portion 78. Long leg 74 extends under and adjacent to flange portion 28 and channel 68 may be connected with flange portion 28 at leg 74 by commonly known methods, including the use of adhesives for example, but is preferably welded (FIGS. 9–11). Channel 68 wraps around rear end 70 of flange portion 28 and rear edge 66 of shelf panel 22 with short leg 76 positioned opposite shelf panel 22 and flange portion 28 from long leg 74, adjacent top surface 80 of shelf panel 22.

Those skilled in the art or those who make or use the invention may modify the invention by using separate lengths of a C-clip channel at each flange portion 28 or a C-clip channel portion of each flange portion 28, instead of the continuous channel 68. Such modification is within the scope of the invention.

A strip of foam tape 82 is applied to rear edge 66 of shelf panel 22 and wraps around to top surface 80 for cushioning between shelf panel 22 and channel 68 and to assure a tight fit (FIGS. 10 and 11). Preferably, foam tape 82 is a strip of approximately 1/16 inch (1.6 mm) thick and 7/16 inch (22.2 mm) wide, extending the length of rear edge 66. Foam tape 82 may be one of any commonly available adhesive-backed foam tapes, including a four pound per cubic foot polyolefin foam with 3M brand 927 adhesive on one of the 7/16 inch (22.2 mm) surfaces, for example.

Front trim 60 and a rear trim piece 84 may be optionally included or deleted, depending upon specific shelving application and stylistic requirements (FIGS. 9–11). Rear trim 84 may be a flange portion extending from channel 68 or may be a separate piece interleaved between channel leg 76 and foam tape 82 and attached to leg 76 (FIG. 11). The spacing between legs 74 and 76 may be adjusted as needed to accommodate either the inclusion or deletion of rear trim piece 84.

In use, shelf assembly 120 is easily assembled by applying foam tape 82 across rear edge 66 of shelf panel 22, aligning rear edge 66 with channel 68, coincidentally aligning fastening studs 36 with large portion 52 of corresponding fastener apertures 38, and inserting studs 36 into aperture 38. Shelf panel 22 is slid relative to support brackets 24 to slide studs 36 into small portions 54 of apertures 38 and to slide rear edge 66 into channel 68 (FIG. 1). Again as discussed above, shoulders 58 and the relatively smaller clearance through throats 56 provide a locking function to hold studs 36 in small portions 54. The slight compression of bushings 46 in small portions 54 provides a snug connection between shelf panel 22 and support bracket 24. Further, foam tape 82 is preferably slightly compressed between shelf panel 22 and channel 68, also providing a snug connection between shelf panel 22 and support bracket 24.

Figure 12:
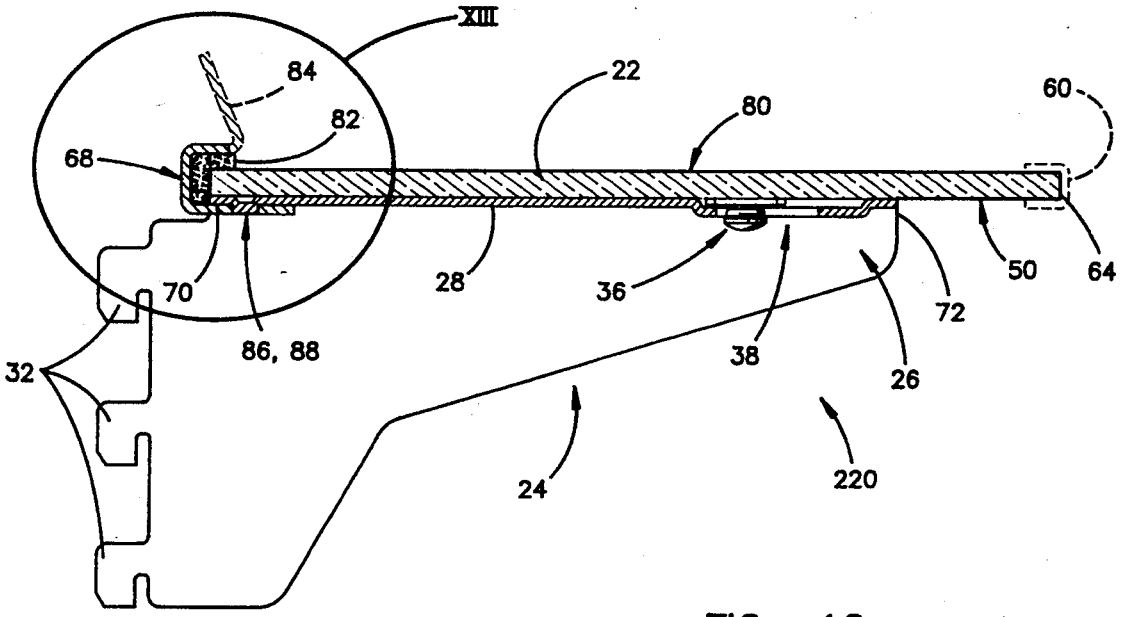
FIG. 12 is the sectional view of FIG. 9 showing a second alternative embodiment of the shelf of FIGS. 1 and 2.
Figure 13:
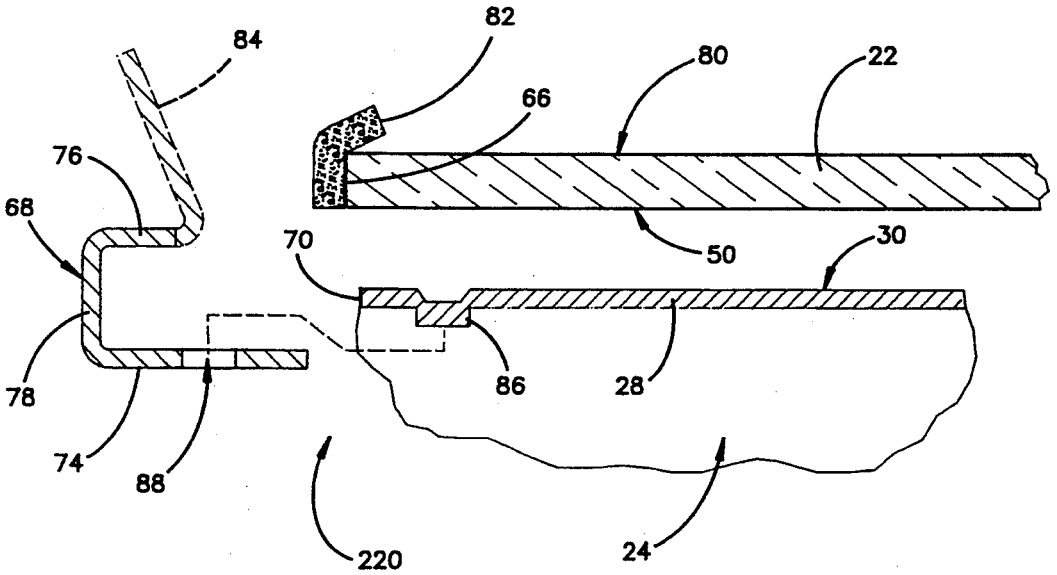
FIG. 13 is an exploded sectional view of detail XIII of FIG. 12.

As shown in FIGS. 12 and 13, a second alternative embodiment 220 of shelf assembly 20 includes channel 68 releasably connected with support brackets 24. Specifically, an anchor stud 86 projects from flange portion 28 of support bracket 24 and a corresponding anchor aperture 88 is provided at each end of channel 68, in long leg 74. Anchor stud 86 projects away from shelf panel 22. Anchor stud 86 and aperture 88 are sized for slip fit engagement with each other.

Shelf assembly 220 is readily assembled by inserting anchor stud 86 of each support bracket 24 into corresponding anchor apertures 88, at opposing ends of channel 68, so that leg 74 of channel 68 is adjacent flange portion 28 and leg 76 is opposite flange portion 28 from leg 74. With channel member 68 and support brackets 24 thusly connected, the assembly of shelf assembly 220 is very similar to the assembly of shelf assembly 120, discussed above. Foam tape 82 is applied to rear edge 66 of shelf panel 22, rear edge 66 is aligned with channel member 68, and fastening studs 36 are aligned with and inserted through large portions 52 of corresponding fastening apertures 38. Shelf panel 22 is slid relative to support brackets 24 to insert rear edge 66 into channel 68 and to position fastening studs 36 in small portions 54 of fastener apertures 38.

Figure 14:
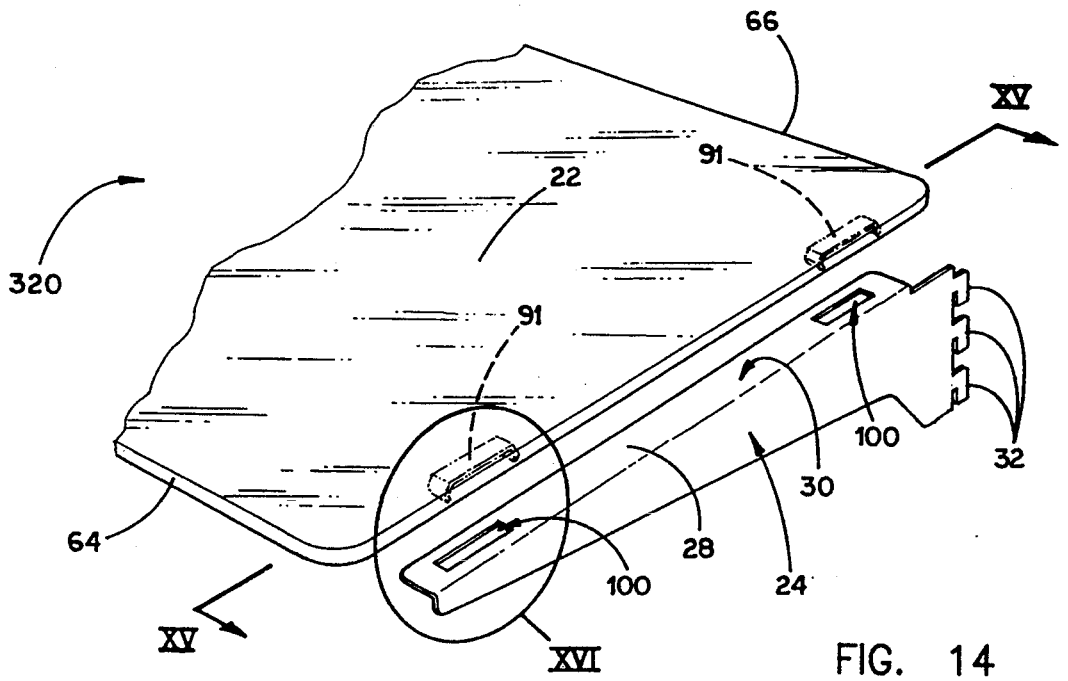
FIG. 14 is an exploded fragmentary perspective view of a second embodiment of a shelf according to the present invention.
Figure 15:
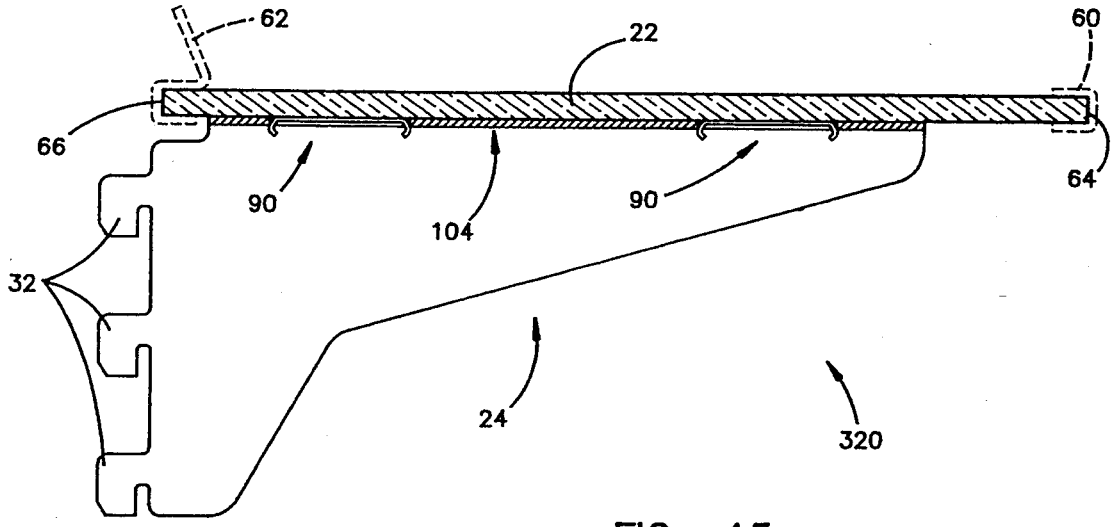
FIG. 15 is a Sectional view along line XV—XV of FIG. 14 showing the shelf assembled.
Figure 16:
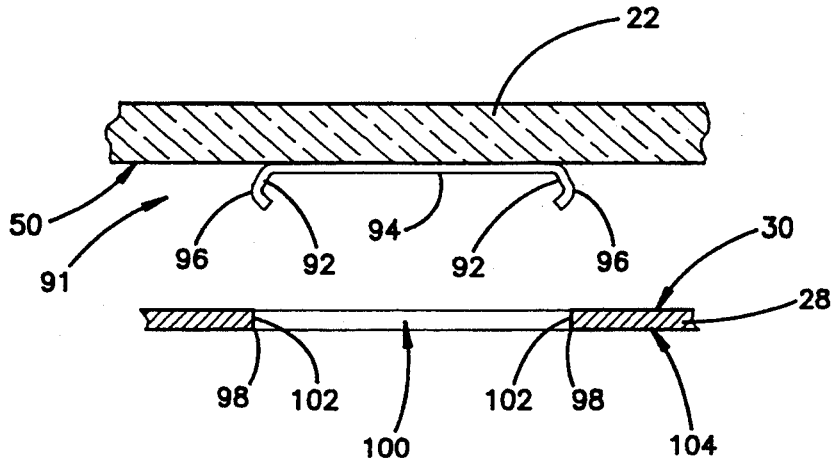
FIG. 16 is a fragmentary sectional view of detail XVI of FIG. 14.
Figure 17:
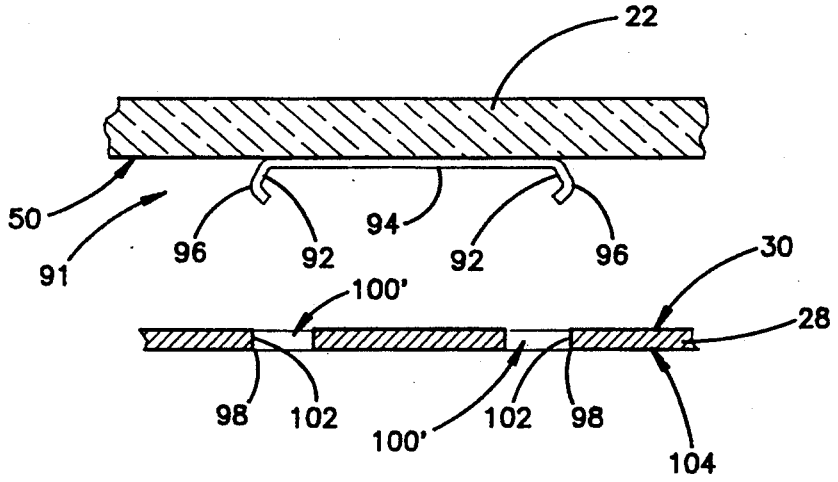
FIG. 17 is a first alternative arrangement of the detail of FIG. 16.
Figure 18:
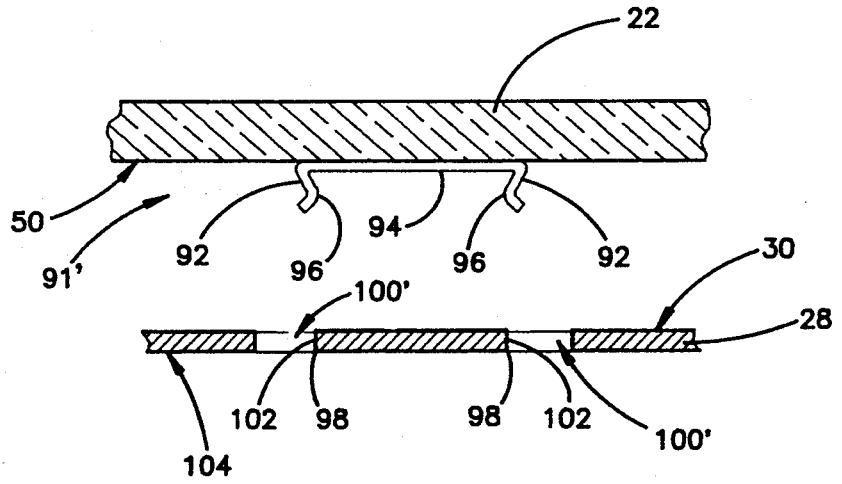
FIG. 18 is a second alternative arrangement of the detail of FIG. 16.

As shown in FIGS. 14 and 15, a third alternative embodiment 320 of shelf assembly 20 includes shelf panel 22 fastened to support brackets 24 with spring fasteners 90. Each spring fastener 90 has a generally U-shaped spring clip 91, having a pair of resilient, spring-like, flexible legs 92 extending in the same general direction from opposing ends of a bight portion 94. Spring clip 91 is preferably bonded to bottom surface 50 of shelf panel 22 as discussed above. Each leg 92 has a latch hook 96 for engaging a catch lip 98, formed at bottom surface 104 of support bracket flange portion 28 by a spring clip aperture 100. Each pair of latch hooks 96 of a pair of legs 92 may project outwardly, away from each other as shown in FIGS. 16 and 17, or may project inwardly, toward each other as shown in FIG. 18.

Each spring clip aperture 100 corresponds in shape to the overall shape of spring clip 90 and defines a catch lip 98 between bottom surface 104 of support bracket flange portions 28 and a side wall 102 of the aperture 100. Spring clip aperture 100 is provided in support surface 30 of support bracket 24. Alternately, spring clip aperture 100′ may be provided for and correspond to each spring clip leg 92 (FIGS. 17 and 18) or a single, large, spring clip aperture 100 may be provided for each pair of spring clip legs 92 (FIG. 16).

While the present invention may be satisfactorily practiced using a single spring fastener 90 to fasten shelf panel 22 to each support bracket 24 and bight portion 94 of spring clip 91 may be sized so that a leg 92 is located near each of front edge 64 and rear edge 66 of shelf panel 22, a pair of spring fasteners 90 and corresponding spring clip apertures 100 are preferably provided for fastening shelf panel 22 with each support bracket 24. Similar to the use of pairs of fasteners 26 in shelf assembly 20, above, use of pairs of spring fasteners 90 enhances the stability of shelf assembly 320 by minimizing the possibility of rotation between shelf panel 22 and support brackets 24.

In use, shelf assembly 320 is simply assembled by forcing each spring clip 91, adhered or bonded on bottom surface 50 of shelf panel 22, into its corresponding spring clip aperture 100, provided in support surface 30 of each support bracket 24. The resiliency of legs 92 allows them to flex and snap into place through the apertures.

Figure 19:
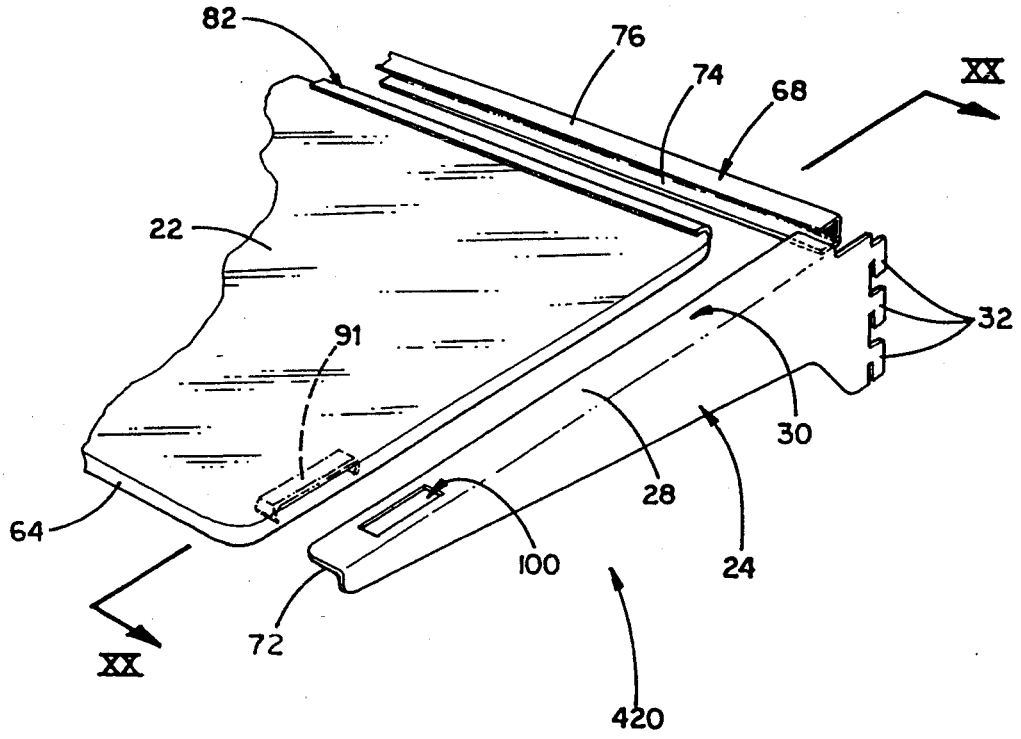
FIG. 19 is an exploded fragmentary perspective view of a first alternative embodiment of the shelf of FIG. 14.
Figure 20:
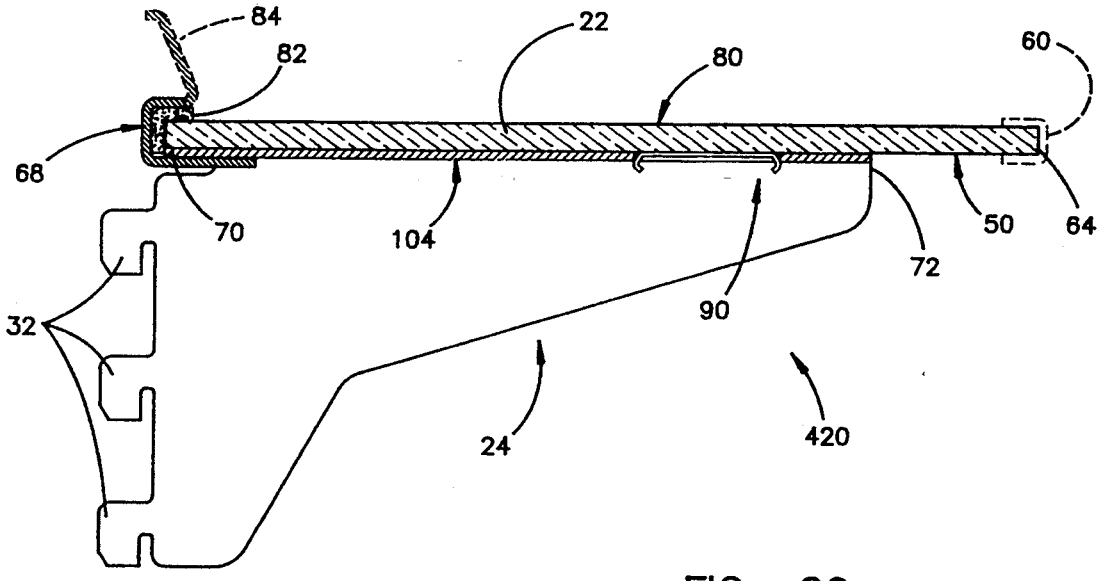
FIG. 20 is a sectional view along line XX—XX of FIG. 19.

With reference to FIGS. 19 and 20, a first alternative embodiment 420 of shelf assembly 320, which is quite similar to shelf assembly 120 discussed above, includes an open sided channel 68 extending between flange portions 28 of support brackets 24 and one spring fastener 90 is used for connecting shelf panel 22 with each support bracket 24. As more specifically discussed above regarding shelf assembly 120, channel 68 has a J-shaped cross section with a long leg 74 connected with flange portion 28, preferably by welding, at the rear end 70 of each support bracket flange portion 28. Spring clip 91 is located near the front edge 64 of shelf panel 22 for alignment and engagement with a spring clip aperture 100, located near the front end 72 of each support bracket flange portion 28. Again, a strip of foam tape 82, as also described above, is applied to the rear edge 66 of shelf panel 22 and wraps around to top surface 80 for cushioning between shelf panel 22 and channel 68, assuring a tight fit. Further, depending upon the specific application and stylistic requirements, front trim 60 and rear trim piece 84 may be optionally included or deleted as discussed in greater detail above (FIGS. 9–11).

Shelf assembly 420 is assembled virtually identically to shelf assembly 120, above. Foam tape 82 is applied to rear edge 66 of shelf panel 22 and rear edge 66 is inserted into channel 68. Each spring clip 91, provided on shelf panel 22, is forced into its corresponding spring clip aperture 100, or apertures 100′, provided in support bracket 24.

Figure 21:
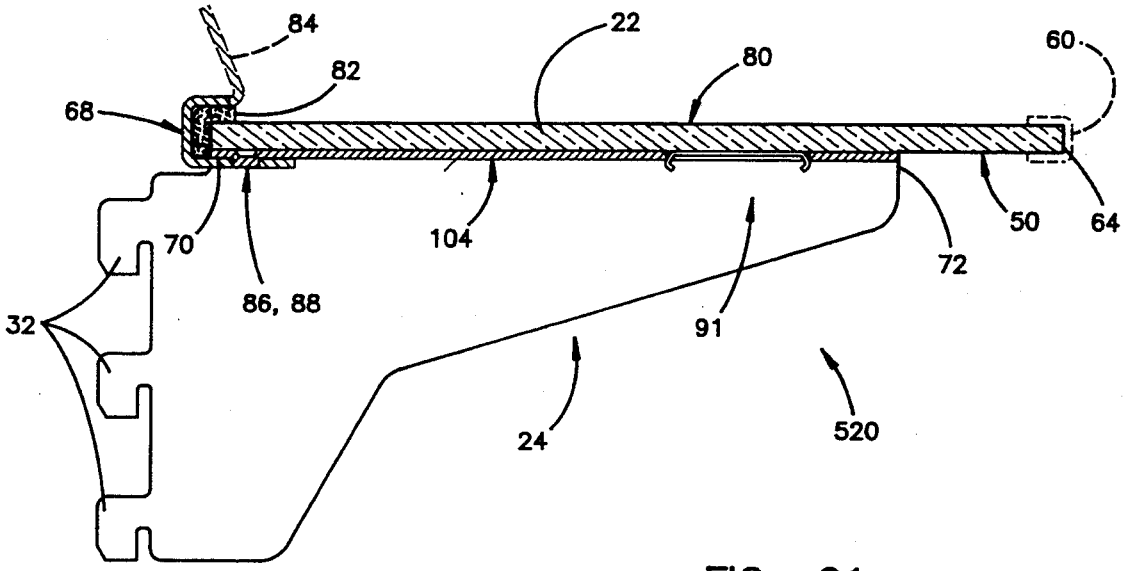
FIG. 21 is the sectional view of FIG. 20 showing a second alternative embodiment of the shelf of FIG. 14.

As shown in FIG. 21, a second alternative embodiment 520 of shelf assembly 320, which is quite similar to shelf assembly 220 discussed in detail above, includes channel 68 releasably connected with support brackets 24 by an anchor stud 86, projecting from flange portion 28 of each support bracket 24, and a corresponding anchor aperture 88, provided at each end of channel 68, in leg 74. Foam tape 82 is again applied to the rear edge 66 of shelf panel 22, wrapping around to top surface 80, for cushioning and fit between shelf panel 22 and channel 68. Further, front trim 60 and rear trim piece 84 may again be optionally included or deleted.

Shelf assembly 520 is also assembled virtually identically to shelf assembly 220, above, by inserting rear edge 66 of shelf panel 22 into channel 68 and forcing spring clips 91, provided on bottom surface 50 of shelf panel 22, into corresponding spring clip apertures 100, 100', provided in support surface 30 of each support bracket 24.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. A shelf assembly comprising:

a shelf panel;

a shelf support bracket having a support surface receiving and supporting said shelf panel, said support surface having a fastening aperture facing said shelf panel; and a spring clip fixed to said shelf panel, said spring clip having a stiff, flexibly resilient member projecting toward said support bracket, extending into said fastening aperture, and releasably snap-fastening said shelf panel and said support bracket together.

2. The shelf assembly defined in claim 1 wherein said member of said spring clip has a catch, said fastening aperture has a cooperating lip, and said catch engages said lip.

3. The shelf assembly defined in claim 2 wherein said spring clip is a generally U-shaped member having a pair of said members extending in the same general direction from opposing ends of a bight portion, said spring clip being fixed to said shelf panel at said bight portion.

4. The shelf assembly defined in claim 3 wherein said shelf panel is glass, said spring clip is a metal member, and said spring clip is bonded to said glass shelf panel.

5. The shelf assembly defined in claim 3 wherein said shelf panel has two opposing ends and wherein one of said shelf support brackets is located near each said opposing end of said shelf panel.

6. The shelf assembly defined in claim 5 wherein:

each said support bracket is an elongated member that extends along and abuts a surface of said shelf panel;

said support brackets are generally parallel to each other;

a pair of said fastening apertures is located in said support surface of each of said support brackets; and one of said spring clips aligns with and engages each said fastening aperture.

7. The shelf assembly defined in claim 3 wherein said support bracket is an elongated member that extends along and abuts a surface of said shelf panel, said support bracket has a first end and an opposing second end, said support bracket has an open sided channel member near said first end, and wherein said shelf panel has an edge positioned in said channel member.

8. The shelf assembly defined in claim 7 wherein said channel member has two flange portions extending in the same general direction from opposing edges of a web portion and a first of said two flange portions is connected with said support bracket.

9. A shelf assembly comprising:

a shelf panel;

a shelf support bracket having a support surface receiving and supporting said shelf panel and having a fastening aperture, said support bracket being an elongated member that extends along and abuts a surface of said shelf panel, said support bracket having a first end and an opposing second end, said support bracket also having an open sided channel member near said first end, said channel member having two flange portions extending in the same general direction from opposing edges of a web portion, a first of said two flange portions being connected with said support bracket and the second of said two flange portions being adjacent said shelf panel, opposite said support bracket, said support bracket having an anchor stud adjacent said support surface and projecting away from said shelf panel, said first flange portion of said channel member having a corresponding anchor aperture adapted for slip fit engagement with said anchor stud, said shelf panel having a rear edge positioned in said channel member; and a generally U-shaped spring clip connected with said shelf panel, said spring clip having a pair of stiff, flexibly resilient, and elongated members projecting toward said support bracket for latching engagement with said fastening aperture to fasten said shelf panel and said support bracket together, said elongated members extending in the same general direction from opposing ends of a bight portion, said spring clip being connected with said shelf panel at said bight portion, each said elongated member having a projecting portion forming a catch for latching engagement with said fastening aperture, said fastening aperture having a lip for latching engagement with said catch.

10. The shelf assembly defined in claim 9 wherein:

said shelf panel has two opposing ends;

said support bracket is an elongated member;

one of said support brackets is located near each said opposing end of said shelf panel; and said support brackets are generally parallel to each other.

11. The shelf assembly defined in claim 10 wherein said fastening aperture is located in said support surface of said support bracket and wherein said spring clip projects from said shelf panel and aligns with and engages said fastening aperture.

12. A shelf assembly comprising:

a support bracket having a support surface, having an open sided channel member near a first end, and having a fastening aperture spaced from said channel member;

a shelf panel supported on said support surface, said shelf panel having a rear edge, said rear edge being positioned in said channel member; and a fastening member connected with said shelf panel, said fastening member engaging said fastening aperture and fastening said support bracket and said shelf panel together.

13. The shelf assembly defined in claim 12 wherein said channel member has two flange portions extending in the same general direction from opposing edges of a web portion, a first of said two flange portions being connected with said support bracket.

14. The shelf assembly defined in claim 13 wherein said fastening member is a stiff, flexibly resilient member projecting toward said support bracket.

15. The shelf assembly defined in claim 14 wherein said fastening member has a catch, said fastening aperture has a cooperating lip, and said catch engages said lip.

16. The shelf assembly defined in claim 13 wherein said fastening member has a shaft portion and has a resilient, compressible bushing circumscribing said shaft portion and wherein said fastening aperture is generally figure eight shaped and is adapted for sliding engagement with said fastening member.

17. The shelf assembly defined in claim 16 wherein said fastening aperture:

has a first portion, sized for slip fit engagement with said fastening member;

has a second portion, sized smaller than the outer dimension of said bushing;

has a throat portion, said throat portion extending between said first and second portions and being sized smaller than said second portion; and is oriented so that said first portion is away from said channel member.

18. The shelf assembly defined in claim 17 wherein said fastening aperture is located in said support surface of said support bracket and wherein said fastening stud projects from said shelf panel and aligns with and engages said fastening aperture.

19. The shelf assembly defined in claim 18 wherein said support bracket has an anchor stud adjacent said support surface and projecting away from said shelf panel and wherein said first flange portion has a corresponding anchor aperture adapted for slip fit engagement with said anchor stud.

20. The shelf assembly defined in claim 18 wherein:

said shelf panel has two opposing ends;

one of said shelf support brackets is located near each said opposing end of said shelf panel;

each said support bracket is an elongated member; and said support brackets are generally parallel to each other.

21. The shelf assembly defined in claim 18 wherein said support bracket has an anchor stud adjacent said support surface and projecting away from said shelf panel and wherein said first flange portion has a corresponding anchor aperture adapted for slip fit engagement with said anchor stud.

22. A shelf assembly comprising:

a support bracket having a support surface for receiving and supporting a shelf panel, having an open sided channel member near a first end, and having a fastening aperture;

a shelf panel supported on said support surface, said shelf panel having a rear edge, said rear edge being positioned in said channel member, said channel member having two flange portions extending in the same general direction from opposing edges of a web portion, a first of said two flange portions being connected with said support bracket and the second of said two flange portions being adjacent said shelf panel, opposite said support bracket; and a fastening member connected with said shelf panel, said fastening member being a stiff, flexibly resilient, and elongated member projecting toward said support bracket, said fastening member also being a generally U-shaped spring clip having a pair of said elongated members extending in the same general direction from opposing ends of a bight portion, said spring clip being connected with said shelf panel at said bight portion, said fastening member also having a projecting portion forming a catch for latching engagement with said fastening aperture, said fastening aperture having a lip for latching engagement with said catch, said fastening member being received in said fastening aperture and fastening said support bracket and said shelf panel together.

23. The shelf assembly defined in claim 22 wherein said shelf panel has two opposing ends and wherein one of said shelf support brackets is located near each said opposing end of said shelf panel.

24. The shelf assembly defined in claim 23 wherein:

each said support bracket is an elongated member that extends along and abuts a surface of said shelf panel;

said support brackets are generally parallel to each other;

a pair of said fastening apertures is located in said support surface of each said support bracket; and one of said spring clips aligns with and engages each said fastening aperture.

* * * * *